US005402909A

United States Patent [19]

Cramer et al.

[11] Patent Number: 5,402,909

[45] Date of Patent: Apr. 4, 1995

[54] DRUM FOR STORING AND DISPENSING LIQUIDS

[75] Inventors: Harley L. Cramer, Swanton; Robert A. Huebner, Toledo, both of Ohio

[73] Assignee: Walbro Corporation, Cass City, Mich.

[21] Appl. No.: 257,483

[22] Filed: Jun. 9, 1994

Related U.S. Application Data

[63] Continuation of Ser. No. 96,667, Jul. 23, 1993, abandoned.

[51] Int. Cl.[6] ..... B65D 39/08

[52] U.S. Cl. ..... 220/601; 220/DIG. 1; 220/DIG. 6

[58] Field of Search ..... 220/601, 661, DIG. 6, 220/DIG. 1, 465, 571, 601, 661

[56] References Cited

U.S. PATENT DOCUMENTS

| | | | |
|---|---|---|---|
| Re. 28,874 | 6/1976 | Hammes | 220/661 |
| 1,413,907 | 4/1922 | Gerstenberger | 220/DIG. 6 |
| 3,891,118 | 6/1975 | Laurizio | 220/601 |
| 4,114,779 | 9/1978 | Stoll, III | 220/601 |
| 4,674,648 | 6/1987 | Przytulla | 220/601 |
| 4,736,862 | 4/1988 | Hammes et al. | 220/601 |
| 4,767,021 | 8/1988 | Pies | 220/601 |
| 4,927,040 | 5/1990 | Cramer | 220/601 |
| 5,014,873 | 5/1991 | Clemens et al. | 220/601 |
| 5,071,028 | 12/1991 | Murphy | 220/669 |

FOREIGN PATENT DOCUMENTS

| | | | |
|---|---|---|---|
| 0309015 | 3/1989 | European Pat. Off. | 220/601 |
| 1536174 | 1/1970 | Germany | 220/DIG. 6 |
| 9112182 | 8/1991 | WIPO | 220/601 |

*Primary Examiner*—Stephen J. Castellano

*Attorney, Agent, or Firm*—Barnes, Kisselle, Raisch, Choate, Whittemore & Hulbert

[57] ABSTRACT

A drum for liquids with a generally cylindrical sidewall and a drainage system in each end wall. One end wall has a peripheral channel opening into a sump from which substantially all the of liquid in the drum can be removed through a dip tube received in the sump and connected to a siphon or a pump. The other end wall has another sump located adjacent the sidewall with a tapered portion extending between them so that when the barrel is turned upside down substantially all of its contents can be drained by gravity through a bunghole in the sump. A plug is removably threaded in the bunghole which preferably overlaps and is generally axially aligned with the sump in the other end wall to facilitate inserting the dip tube.

11 Claims, 1 Drawing Sheet

DRUM FOR STORING AND DISPENSING LIQUIDS

This is a continuation of application Ser. No 08/096,667, filed on Jul. 23, 1993, now abandoned.

FIELD OF THE INVENTION

This invention relates to containers and more particularly to a drum for storing and dispensing liquids.

BACKGROUND OF THE INVENTION

When liquid substances and particularly liquid chemicals are poured or dispensed from a conventional barrel or drum it does not become completely empty. Some of the liquid remains in the drum regardless of whether its contents are poured out through the bunghole or removed by a pump or siphon dip tube. The contents remaining in the drum create disposal and environmental problems and are an economic waste of the remaining liquid chemicals. The remaining liquid chemicals must be removed from the drum and disposed of in an environmentally safe manner and the drum cleaned before it can be reused or disposed of. Therefore there are substantial economic costs associated with the failure of a drum to become completely empty or drained out in the ordinary course of dispensing its contents.

SUMMARY OF THE INVENTION

A drum with a generally cylindrical sidewall and drainage systems in both ends. To provide drainage, when the drum is turned upside down, the upper end has an inclined portion adjacent the sidewall which merges into a sump with a bunghole in the lowermost portion thereof in which a bung or plug is removably receivable. To facilitate complete draining with a pump or siphon, the bottom end has a central raised portion merging into a peripheral channel opening into a sump aligned with the bunghole to receive in the sump the lower end of a dip tube connected to a pump intake or siphon tube.

Objects, features and advantages of this invention are to provide a drum which increases utilization of its entire contents, becomes substantially completely empty when its contents are dispensed in a conventional manner, substantially reduces environmental problems and the cost of cleaning, removal and treatment of any residue, is of simple design and economical manufacture and easily used for storage and dispensing of liquid substances.

BRIEF DESCRIPTION OF THE DRAWINGS

These and other objects, features and advantages of this invention will be apparent from the following detailed description of the best mode, appended claims and accompanying drawings in which:

DETAILED DESCRIPTION

Figure 1:
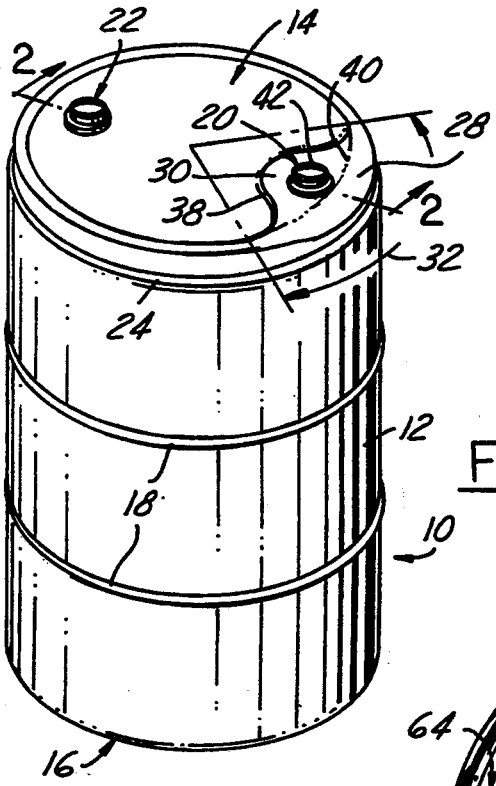
FIG. 1 is a perspective view of a drum embodying this invention.

FIG. 1 illustrates a drum 10 embodying this invention with a generally cylindrical sidewall 12, an upper end or top wall 14 and a lower end or bottom wall 16. Preferably, the drum has both a dispensing or pour out flange opening or bunghole 20 and a vent bunghole 22 in its upper wall, which are preferably generally diametrically opposed. Preferably to facilitate moving by rolling a filled drum, a pair of axially spaced apart hoops or ribs 18 extend circumferentially continuously around the sidewall, project radially outwardly thereof and preferably have a generally arcuate convex cross section. Preferably, to facilitate lifting and carrying the drum, it has a circumferentially continuous recess or groove 24 in the sidewall adjacent the upper end. Preferably, the drum has an internal volume or capacity of 55 gallons and is blow molded of a high density plastic or resin material, such as polyethylene, so that the end walls and the sidewall are homogeneously integral.

Figure 2:
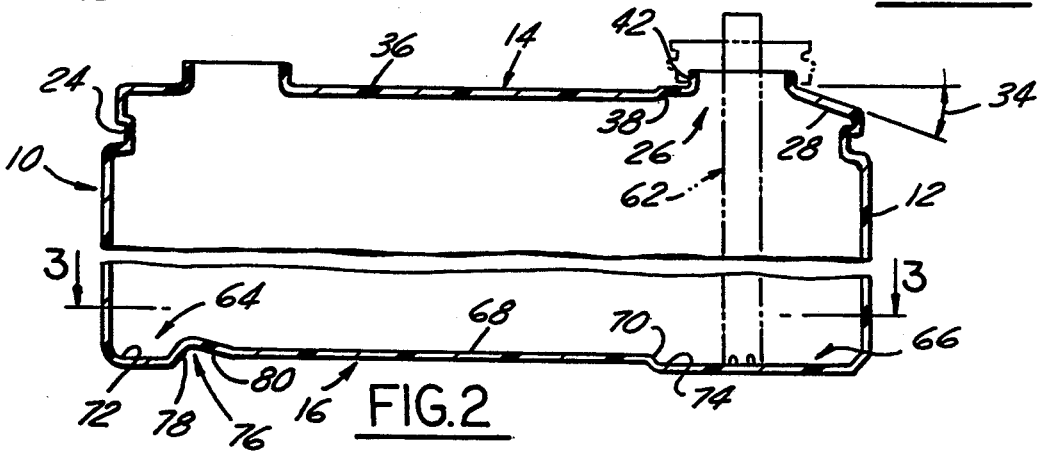
FIG. 2 is a fragmentary sectional view taken generally on line 2—2 of FIG. 1.

In accordance with one feature of this invention, the upper end of the drum has a drainage system 26 (FIG. 2) which enables the contents of the drum to be essentially completely discharged through the dispensing bunghole 20 when the drum is turned upside down (FIG. 5) so that the dispensing bunghole 20 becomes vertically the lowest point of the drum and the end wall slopes downwardly toward this bunghole. As shown in FIGS. 1 and 2, the drainage system has a tapered end wall portion 28 which slopes toward a sump 30 in which the dispensing bunghole 20 is disposed. The tapered portion 28 is inclined to both the sidewall 12 and the endwall 14 and slopes toward and merges into the sump portion and in a plan view (FIG. 1) , has a generally crescent shape with an arcuate extent 32 of less than 120° usually about 75° to 120° and preferably about 90° to 100°. Preferably, the tapered portion 28 is inclined at an acute included angle 34 to the plane of the central portion 36 of the end wall of 10° to 30° and preferably about 20°. The tapered portion 28 is disposed between the sump and the sidewall and preferably merges into them.

As shown in FIGS. 1 and 2, the sump 30 is axially offset by an inclined wall portion 38 from the preferably planar central portion 36 so that when the drum is turned upside down it is below the central portion. Preferably, the sump is generally flat, semi-circular in configuration and adjacent its radially outer edge 40 blends into the tapered portion 28. The dispensing bunghole 20 is located in the lowermost portion of the sump when turned upside down (FIG. 5) and has a neck 42 blending into and projecting from the sump.

Figure 4:
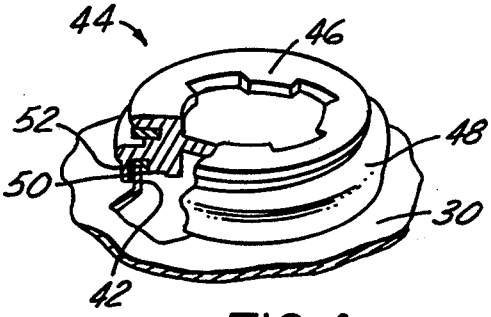
FIG. 4 is a fragmentary perspective view with portions broken away and in section of the bunghole and closure plug of the drum.

As shown in FIG. 4, preferably a closure assembly 44 with a removable plug 46 in a carrier ring 48 is received on the neck. Preferably, the plug and ring are of a thermoplastic material and the ring 48 is permanently attached and sealed to the neck by an annulus 50 of a suitable thermoplastic bonding material received in a groove 52 in the ring. Preferably, the bonding material has ferromagnetic particles in a thermoplastic matrix which is induction heated to melt and fuse with the carrier ring 48 and the neck 42. A suitable closure 44 and bonding material are commercially available from Rieke Corporation of Auburn, Ind. 46706 under the trade designation PDF-6 Plastic Closure. Suitable induction heating equipment is commercially available from Emabond Systems Unit of the Specialty Polymer & Adhesives Division of the Ashland Chemical Company Division of Ashland Oil, Inc. of Norwood, N.J.

Preferably, the vent bunghole 22 also has a neck 54 integral with the planar portion 36 of the end wall 14 on which another closure 44 with a plug 46 and carrier ring 48 is attached and sealed by bonding material 50. Preferably, this is also a PDF-6 Plastic Closure. Preferably, the vent bunghole 22 and neck 54 are disposed on the top end in radially or diametrically opposed relation to the dispensing bunghole 20 and adjacent the sidewall of the drum.

Figure 3:
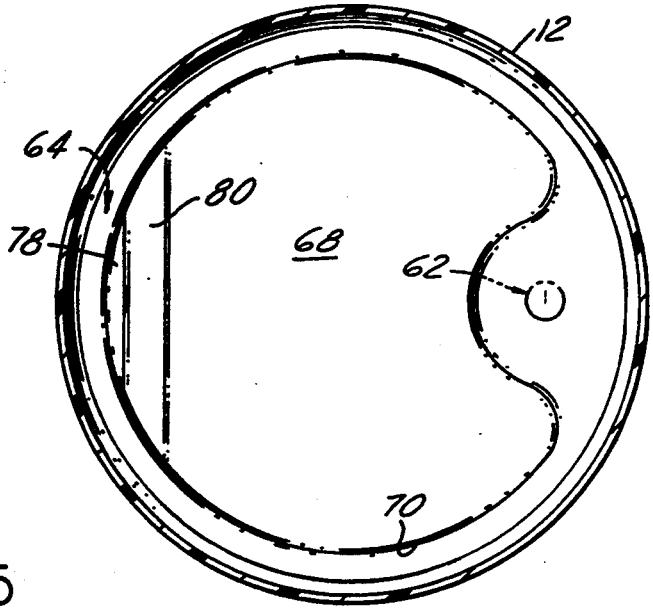
FIG. 3 is a sectional view taken generally on line 3—3 of FIG. 2.

In accordance with another feature of this invention, the drum has a drainage system 60 in the bottom wall for substantially essentially complete drainage of the drum by a dip tube 62 connected to a siphon or pump, when the drum is disposed as shown in FIG. 1 with its bottom extending horizontally, such as when received on a horizontal support surface. As shown in FIGS. 2 and 3, the system 60 has a channel or groove 64 extending around the periphery of the interior of the bottom of the drum and opening into a sump 66 in which the inlet end of the dip tube 62 is received. The dip tube 62 or a submergible pump is inserted through the dispensing bunghole 20 and preferably threadedly engages the ring 48 of the closure 44.

The bottom wall has a raised central portion or prominence 68 with a slightly crowned or preferably flat upper face and a downwardly and outwardly sloping peripheral edge portion 70 which merges into preferably flat bottom wall portions 72 and 74 of the channel and sump. The outer periphery of the channel and sump is defined by the sidewall 12 and their inner periphery is defined by the sloping edge 70 of the prominence 68 so that as the level of liquid remaining in the drum drops below the upper face of the prominence it flows down the sidewall into the channel and the sump. Any liquid on the prominence also flows into the channel and sump.

The configuration of the channel, sump and prominence also stiffens the bottom of the drum and the planar bottom face of the channel and sump provide a stable surface for supporting the drum.

Preferably, to facilitate manually gripping and tipping the drum a recess 76 is formed in the exterior of the bottom for engagement by the fingers of a hand gripping the edge of the drum. The recess is formed by interconnecting wall portions 78 and 80 which extend into the channel and prominence. Preferably, this hand grip recess 76 is diametrically opposed to the lower sump and the upper dispensing bunghole 20 and extends transversely across the bottom of the drum. Preferably, the surface area of the channel and sump is only about 35% to 25% of the surface area of the bottom wall.

Figure 5:
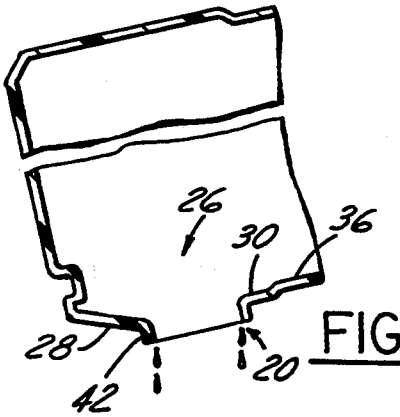
FIG. 5 is a fragmentary sectional view illustrating the drum when turned upside down to drain through the bunghole.

In use, to pour substantially all the contents from the drum through the bunghole 20, the drum is turned upside down and oriented as shown in FIG. 5 so that both of the end wall portions 28 and 36 extend downwardly toward the sump 30 and the bunghole 20. In this position and with the plug 46 removed, the entire contents of the drum can flow due to gravity through the neck 42 and out of the drum.

When it is desired to completely empty the drum using the dip tube 62 with a pump or siphon, the drum can be disposed as shown FIG. 2 with the bottom of the channel 64 and the sump 66 lying essentially in a horitonal plane. As the level of liquid in the drum drops below the central prominence 68 it drains by gravity from the prominence and also down the sidewall of the drum into the channel and sump from which it is removed by the siphon or pump.

Whether liquid is dispensed from the drum through the outlet bunghole 22 or is removed by a pump or siphon from the bottom of the drum, it can be essentially completely emptied. This maximizes utilization of the entire contents of the drum and minimizes the quantity of any residual liquid which must be removed, treated and disposed of in an environmentally safe and acceptable manner. This also minimizes the cost of any necessary cleaning of the drum for reuse or disposal of the drum.

We claim

1. A drum comprising, a container for liquid having a generally cylindrical sidewall and first and second axially spaced apart and generally opposed end walls extending generally transversely of said sidewall, said sidewall and said end walls being homogenously integral in one piece and of a plastic material, said first end wall having a raised central prominence generally axially offset from and merging into a channel and a first sump which together are circumferentially continuous and encircle said raised central prominence, said first sump having a generally radial width greater than the radial width of said channel, the outer periphery of said channel and said first sump being adjacent to and merging into said cylindrical sidewall, and said channel communicating with said first sump so that when they are disposed in a horizontal plane with said cylindrical sidewall upstanding therefrom as the level of liquid drops below said raised central prominence it will drain from said raised central prominence and said sidewall into said channel and first sump, and said second end wall having a central portion and a sump-forming portion therein axially offset outwardly from all of the central portion of said second end wall and disposed adjacent said sidewall, said sump-forming portion being the most upward portion of said second end wall when the drum is supported on said first end wall, a bunghole in said sump-forming portion opening to the exterior of said container, a closure removably secured to said drum to close said bunghole, said bunghole being generally axially aligned with said first sump in said first end wall so that when the drum is supported on its first end wall and said closure is removed from said bunghole substantially all of the contents of the drum can be removed therefrom through a tube inserted through said bunghole and extending down into said first sump, and said second end wall having a tapered portion disposed between said sidewall and said sump-forming portion, inclined at an acute angle to said central portion of said second end wall and said sump-forming portion, sloping toward and merging into said sump-forming portion and extending circumferentially not more than about one-third of the circumference of said sidewall so that when the drum is turned upside down said sump-forming portion becomes a second sump and the tapered portion extends downwardly toward the second sump and the bunghole for draining substantially all of the contents of the drum therefrom when the closure is removed.

2. The drum of claim 1 wherein said central prominence of said first end wall has a substantially flat portion with a surface area equal to about at least two-thirds of the surface area of said first end wall.

3. The drum of claim 1 wherein the bottom of said channel and the bottom of said first sump lie in substantially the same plane.

4. The drum of claim 1 wherein the sum of the surface area of the bottom of said channel and of the bottom of said first sump is not greater than about 35% of the surface area of said first end wall.

5. The drum of claim 1 wherein the outer periphery of said channel and of said first sump is defined by said cylindrical sidewall of the drum.

6. The drum of claim 1 which also comprises another bunghole carried by said second wall and located adjacent said sidewall and generally diametrically opposed to said bunghole in said sump-forming portion.

7. The drum of claim 1 which also comprises said sump-forming portion opening into a neck extending generally axially outwardly of said sump-forming portion and at least in part defining said bunghole, a carrier ring received on and sealed to said neck, and said closure comprising a plug threadably and removably received in said carrier ring to close said bunghole.

8. The drum of claim 1 wherein said tapered portion of said second end wall is inclined at an acute included angle to said central portion of said second end wall of not more than about 30°.

9. The drum of claim 1 wherein said tapered portion of said second end wall extends circumferentially through an arc of not more than about 100°.

10. A drum comprising, a container for liquid having a generally cylindrical sidewall and first and second axially spaced apart and generally opposed end walls extending generally transversely of said sidewall, said first end wall having a raised central prominence generally axially offset inwardly from and merging into a channel and a first sump which together are circumferentially continuous and encircle said raised central prominence, said first sump having a generally radial width greater than the radial width of said channel, the outer periphery of said channel and said first sump being adjacent to and merging into said cylindrical sidewall, and said channel communicating with said first sump so that when they are disposed in a horizontal plane with said cylindrical sidewall upstanding therefrom as the level of liquid drops below said raised central prominence it will drain from said raised central prominence and said sidewall into said channel and first sump, and said second end wall having a central portion and a sump-forming portion therein axially offset outwardly from all of the central portion of said second end wall and disposed adjacent said sidewall, a bunghole in said sump-forming portion opening to the exterior of said container, a closure removably secured to said drum to close said bunghole, said bunghole being generally axially aligned with said first sump in said first end wall so that when the drum is supported on its first end wall and said closure is removed from said bunghole substantially all of the contents of the drum can be removed therefrom through a tube inserted through said bunghole and extending down into said first sump, and said second end wall having a tapered portion disposed between said sidewall and said sump-forming portion, inclined at an acute angle to said central portion of said second end wall and said sump-forming portion, sloping toward and merging into said sump-forming portion and extending circumferentially not more than about one-third of the circumference of said sidewall so that when the drum is turned upside down said sump-forming portion becomes a second sump and the tapered portion extends downwardly toward the second sump and the bunghole for draining substantially all of the contents of the drum therefrom when the closure is removed from the bunghole, said sump-forming portion opening into a neck extending generally axially outwardly of said sump-forming portion and at least in part defining said bunghole, a carrier ring received on and sealed to said neck, said closure comprising a plug threadably and removably received in said carrier ring to close said bunghole, said neck and said carrier ring are both made of a thermoplastic material and are connected and sealed together by thermoplastic material fused to them.

11. The drum of claim 10 wherein said sidewall and said end walls are one piece of a homogeneously integral plastic material.

* * * * *